US008789910B2

(12) United States Patent
Fujisawa et al.

(10) Patent No.: US 8,789,910 B2
(45) Date of Patent: Jul. 29, 2014

(54) IMAGE FORMATION APPARATUS

(75) Inventors: Kazutoshi Fujisawa, Okaya (JP); Yoshimitsu Hayashi, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 231 days.

(21) Appl. No.: 13/363,777

(22) Filed: Feb. 1, 2012

(65) Prior Publication Data

US 2012/0194598 A1 Aug. 2, 2012

(30) Foreign Application Priority Data

Feb. 1, 2011 (JP) ..... 2011-019529

(51) Int. Cl.
*B41J 29/38* (2006.01)

(52) U.S. Cl.
USPC ..... 347/16; 347/102

(58) Field of Classification Search
USPC ..... 347/16, 102
See application file for complete search history.

(56) References Cited

U.S. PATENT DOCUMENTS

| | | | | |
|---|---|---|---|---|
| 6,834,948 | B2 | 12/2004 | Asano et al. | |
| 2006/0187285 | A1 * | 8/2006 | Oyanagi et al. | 347/100 |
| 2009/0225143 | A1 * | 9/2009 | Fukui | 347/102 |
| 2009/0280302 | A1 | 11/2009 | Fukumoto et al. | |
| 2011/0310204 | A1 | 12/2011 | Ohnishi | |

FOREIGN PATENT DOCUMENTS

| | | | | |
|---|---|---|---|---|
| JP | 2002292907 | A | 10/2002 | |
| JP | 2003-191594 | A | 7/2003 | |
| JP | 2003-191594 | * | 9/2003 | B41M 5/00 |
| JP | 2004249617 | A | 9/2004 | |
| JP | 2004358931 | A | 12/2004 | |
| JP | 2005329584 | A | 12/2005 | |
| JP | 2006142613 | A | 6/2006 | |
| JP | 2006231795 | A | 9/2006 | |
| JP | 2009057548 | A | 3/2009 | |
| JP | 2011-011502 | A | 1/2011 | |
| WO | 2010/111121 | A1 | 9/2010 | |
| WO | 20101098041 | A1 | 9/2010 | |

OTHER PUBLICATIONS

Extended European Search Report dated Apr. 17, 2012 as received in application No. 12153449.9.

* cited by examiner

*Primary Examiner* — Manish S Shah
*Assistant Examiner* — Yaovi Ameh
(74) *Attorney, Agent, or Firm* — Maschoff Brennan

(57) ABSTRACT

An image formation apparatus includes a liquid droplet adhesion unit which makes a first and second type of liquid droplet adhere to a recording medium, an irradiator which irradiates electromagnetic waves individually onto the droplets, an irradiation controller which makes the irradiator irradiate the electromagnetic waves periodically, and a frequency setting unit which sets a frequency of an irradiation period to a first frequency such that surface glossiness of the first-type liquid droplet is equal to or higher than a predetermined threshold value, and sets a frequency of the irradiation period to a second frequency which is different from the first frequency such that surface glossiness of the second-type liquid droplet is lower than the threshold value.

9 Claims, 4 Drawing Sheets

| | GLOSS MODE | | SEMI-GLOSS MODE | | MATTE MODE | |
|---|---|---|---|---|---|---|
| USAGE OF CL | AVAILABLE | UNAVAILABLE | AVAILABLE | UNAVAILABLE | AVAILABLE | UNAVAILABLE |
| W | 0 Hz | 0 Hz | 0 Hz | 0 Hz | 0 Hz | 0 Hz |
| C | 0 Hz | 200 Hz | 0 Hz | 10 Hz | 0 Hz | 0 Hz |
| M | 0 Hz | 200 Hz | 0 Hz | 10 Hz | 0 Hz | 0 Hz |
| Y | 0 Hz | 200 Hz | 0 Hz | 10 Hz | 0 Hz | 0 Hz |
| K | 0 Hz | 200 Hz | 0 Hz | 10 Hz | 0 Hz | 0 Hz |
| CL | 200 Hz | | 10 Hz | | 0 Hz | |

| | GLOSS MODE | | SEMI-GLOSS MODE | | MATTE MODE | |
|---|---|---|---|---|---|---|
| USAGE OF CL | AVAILABLE | UNAVAILABLE | AVAILABLE | UNAVAILABLE | AVAILABLE | UNAVAILABLE |
| W | 0 Hz | 0 Hz | 0 Hz | 0 Hz | 0 Hz | 0 Hz |
| C | 0 Hz | 200 Hz | 0 Hz | 10 Hz | 0 Hz | 0 Hz |
| M | 0 Hz | 200 Hz | 0 Hz | 10 Hz | 0 Hz | 0 Hz |
| Y | 0 Hz | 200 Hz | 0 Hz | 10 Hz | 0 Hz | 0 Hz |
| K | 0 Hz | 200 Hz | 0 Hz | 10 Hz | 0 Hz | 0 Hz |
| CL | 200 Hz | | 10 Hz | | 0 Hz | |

IMAGE FORMATION APPARATUS

CROSS REFERENCES TO RELATED APPLICATIONS

The entire disclosure of Japanese Patent Application No. 2011-019529, filed Feb. 1, 2011 is expressly incorporated herein by reference.

BACKGROUND

1. Technical Field

The present invention relates to an image formation apparatus including an irradiator which irradiates electromagnetic waves onto a liquid droplet adhered to a recording medium.

2. Related Art

A recording apparatus has been proposed which controls a flashing light source to irradiate a flash of light onto light-curable ink at least once. One example of such a recording apparatus is found in Japanese Patent Application No. JP-A-2006-142613. Since it is ensured that the ink is irradiated with a flash of light at least once, ink can be cured reliably.

In JP-A-2006-142613, ink can be cured reliably but there has been a problem in that surface glossiness of an ink droplet cannot be adjusted. That is to say, there has been a problem in that surface glossiness of the ink droplet, depending on the ink type, cannot be realized. For example, the desired surface glossiness required for ink droplets differs between ink specifically designed for enhancing glossiness of a surface of a printed material and the ink constituting a base of the printed material.

SUMMARY

An advantage of some aspects of the invention is to provide a technique of realizing surface glossiness suitable for a type of a liquid droplet.

In an image formation apparatus according to an aspect of the invention, a liquid droplet adhesion unit makes a first-type liquid droplet and a second-type liquid droplet which is different from the first-type liquid droplet adhere to a recording medium. An irradiator irradiates electromagnetic waves individually onto the first-type liquid droplet and the second-type liquid droplet which have been adhered to the recording medium. An irradiation controller makes the irradiator irradiate the electromagnetic waves periodically. A frequency setting unit sets a frequency of an irradiation period which is a period in which the electromagnetic waves are irradiated by the irradiator to a first frequency such that surface glossiness of the first-type liquid droplet is equal to or higher than a predetermined threshold value. On the other hand, the frequency setting unit sets the frequency of the irradiation period to a second frequency which is different from the first frequency such that surface glossiness of the second-type liquid droplet is lower than the threshold value. Therefore, surface glossiness of the first-type liquid droplet can be made to be higher than the threshold value and surface glossiness of the second-type liquid droplet can be made to be equal to or lower than the threshold value. That is to say, surface glossiness suitable for each of types of liquid droplets can be realized.

It is to be noted that the above effect of the invention can be obtained in a single image formation apparatus and can be also realized in a case where the image formation apparatus is provided on another apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1A:
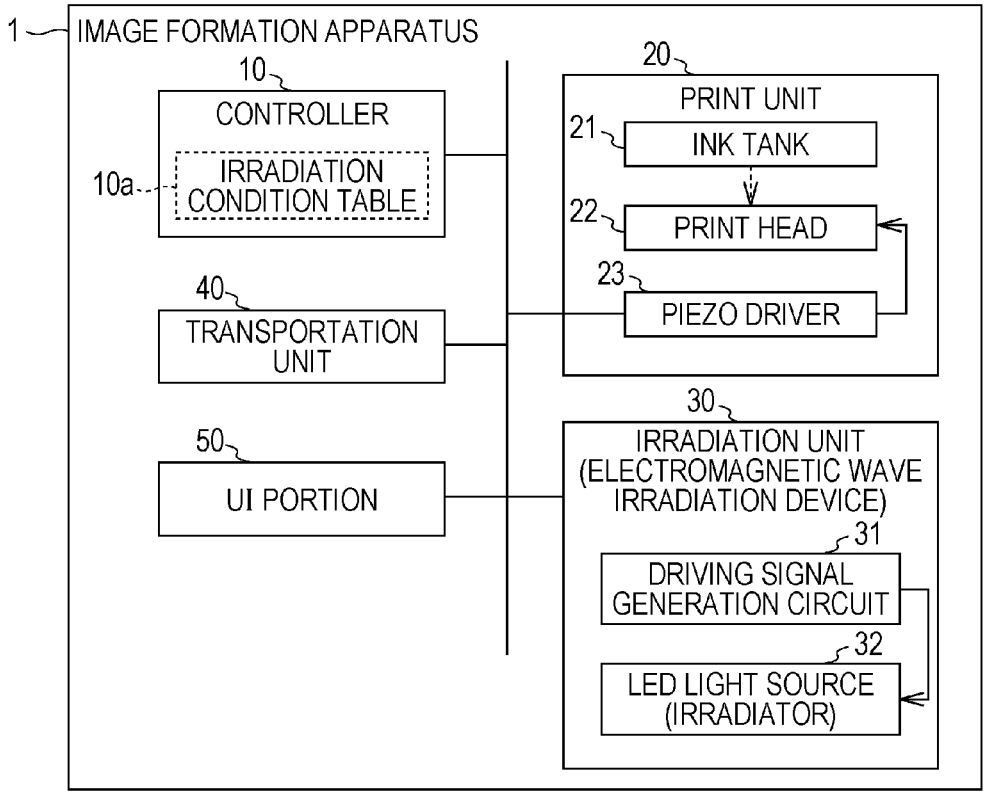
FIG. 1A is a block diagram illustrating an image formation apparatus.

Hereinafter, an embodiment of the invention is described with reference to the accompanying drawings in the following order. It is to be noted that in the drawings, corresponding components are denoted with the same reference numerals and description thereof is not repeated.

1. Configuration of Image Formation Apparatus
2. Print Result
3. Variations

1. Configuration of Image Formation Apparatus

FIG. 1A is a block diagram illustrating an image formation apparatus 1 according to an embodiment of the invention. The image formation apparatus 1 is a line type ink jet printer which forms a printed image on a recording medium with ultraviolet curable ink. The image formation apparatus 1 includes a controller 10, a print unit 20, irradiation units 30, a transportation unit 40, and a UI (user interface) portion 50. The controller 10 includes an ASIC, a CPU, a ROM, and a RAM (not illustrated). The ASIC and the CPU which executes programs recorded in the ROM execute various arithmetic processes for performing a print control process, described more fully below. In the embodiment, the recording medium is a transparent resin film.

The print unit 20 includes ink tanks 21, print heads 22, and piezoelectric drivers 23. The ink tanks 21 store inks to be supplied to the print heads 22. The ink tanks 21 in the embodiment store inks of white (W), cyan (C), magenta (M), yellow (Y), black (K), and clear (CL) (transparent), respectively. Each ink is ultraviolet curable ink and contains an ultraviolet polymerizable resin which receives energy of ultraviolet rays as electromagnetic waves to proceed in polymerization, a polymerization initiator, a color material (excluding CL), and the like. The ink tanks 21 store ultraviolet curable inks as described in JP-A-2009-57548, for example.

Figure 1B:
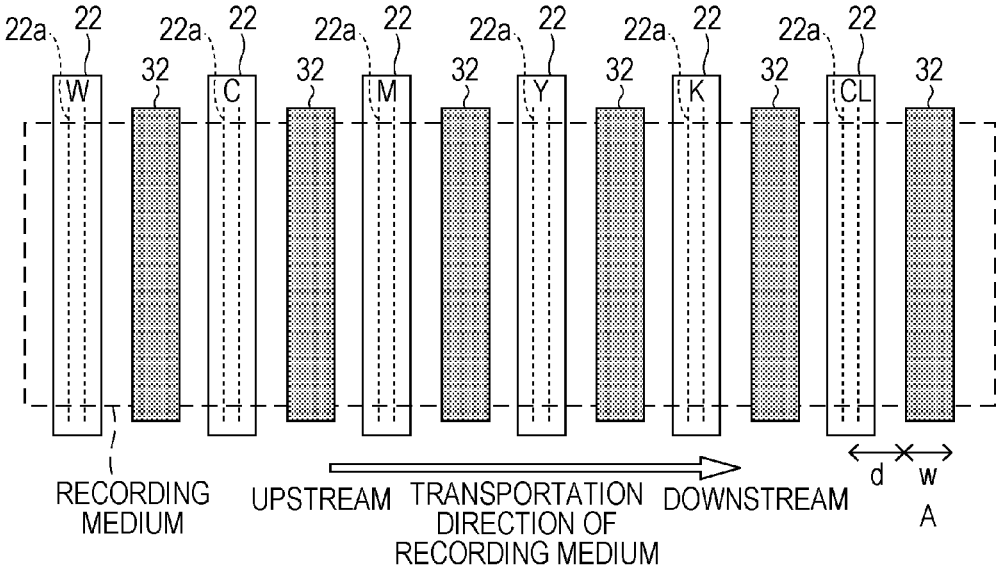
FIG. 1B is a bottom view illustrating the print heads of the image formation device.

FIG. 1B is a bottom view illustrating the print heads 22 when seen from the side of the recording medium. Each print head 22 is provided for each ink type. The print heads 22 are arranged in the order of W→C→M→Y→K→CL from an upstream side in a transportation direction of the recording medium (indicated by a dashed line). Each print head 22 has a nozzle face which is opposed to the recording medium and includes a plurality of nozzles 22*a* arranged on the nozzle face. The nozzles 22*a* are linearly arranged on the print heads 22 and arrangement direction of the nozzles 22*a* corresponds to a width direction of the recording medium (direction perpendicular to the transportation direction). Further, the nozzles 22*a* are arranged in a range wider than the width of the recording medium. The nozzles 22*a* communicate with ink chambers (not illustrated) and inks supplied from the ink tanks 21 are filled into the ink chambers. A piezoelectric element (not illustrated) is provided on the ink chamber for each nozzle 22*a* and a piezoelectric driver 23 applies a driving voltage pulse to the piezoelectric elements based on a control signal from the controller 10. If the driving voltage pulse is applied, the piezoelectric elements are mechanically deformed so that inks filled in the ink chambers are pressurized and decompressed. With this, ink droplets are discharged toward the recording medium through the nozzles 22*a*. The nozzles 22*a* are arranged in a range wider than the width of the recording medium. Therefore, ink droplets can be adhered to the entire range of the recording medium in the width direction. In the embodiment, an ink droplet is discharged by a weight c (for example, c=10 ng) per shot such that an average thickness of the ink droplet formed on the recording medium is equal to or larger than 5 μm and equal to or smaller than 10 μm. It is to be noted that the print heads 22 correspond to a liquid droplet adhesion unit.

Each irradiation unit 30 includes a driving signal generation circuit 31 and an LED light source 32. It is to be noted that the LED light source 32 corresponds to an irradiator. As illustrated in FIG. 1B, each irradiation unit 30 is provided for each ink type and the LED light sources 32 are provided at positions separated from the print heads 22 to a downstream side in the transportation direction of the recording medium by a predetermined distance d (for example, d=50 mm). Each LED light source 32 is formed by arranging a plurality of LED light emitting elements in the width direction of the recording medium. The LED light sources 32 irradiate ultraviolet rays as electromagnetic waves substantially uniformly onto the entire range of the recording medium in the width direction. An irradiation range A in which ultraviolet rays are irradiated onto the recording medium from each LED light source 32 has a predetermined width w (for example, w=80 mm) in the transportation direction. If the recording medium is transported in the transportation direction, the ink droplets discharged from each print head 22 can be located into the irradiation range A of each LED light source 32 provided at the downstream side from the print head 22 by the predetermined distance d. Therefore, polymerization on the ink droplets adhered to the recording medium is initiated and proceeds with energy of the ultraviolet rays irradiated by the LED light source 32. That is to say, the ink droplets discharged from each print head 22 are cured by each LED light source 32 provided at the downstream side of each print head 22.

The driving signal generation circuits 31 generate driving signals to be supplied to the LED light sources 32 based on a control signal from the controller 10. A driving signal generation circuit 31 is provided for each LED light source 32 and each generates a different driving signal for each LED light source 32. Accordingly, ink droplets can be cured under irradiation conditions of the ultraviolet rays, which are different depending on ink types corresponding to the print heads 22. An irradiation condition table 10*a* is recorded in the ROM (not illustrated) in the controller 10 and the controller 10 specifies driving signals to be output to the driving signal generation circuits 31 with reference to the irradiation condition table 10*a*.

Figures 2A, 2B:
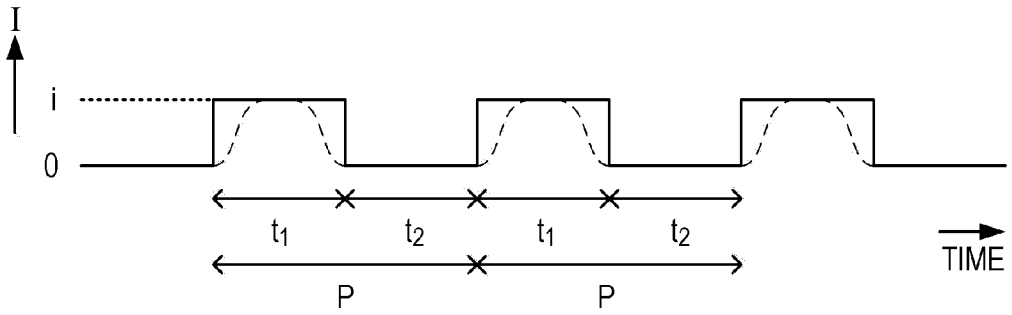
FIG. 2A is a graph illustrating a driving signal.
FIG. 2B is a table illustrating an irradiation condition table.

FIG. 2A is a timing chart illustrating the driving signal. A vertical axis in FIG. 2A indicates a current value of the driving signal and irradiance of each LED light source 32 and a horizontal axis indicates time. The driving signal in the embodiment is a rectangular-pulse current having a current value I of either of 0 or a predetermined value i (value corresponding to irradiance of approximately 0.75 W/cm$^2$). The LED light source 32 irradiates ultraviolet rays for an irradiation time $t_1$ during which the current value I is the predetermined value i. The LED light source 32 does not irradiate ultraviolet rays for a termination time $t_2$ during which the current value I is 0. In the embodiment, a ratio of a length of the irradiation time $t_1$ and a length of the termination time $t_2$ is 1:1. Further, a sum of the length of the irradiation time $t_1$ and the length of the termination time $t_2$ corresponds to an irradiation period P. It is to be noted that the irradiation period P corresponds to a period for which ultraviolet rays are irradiated by the LED light source 32 for the irradiation time $t_1$. Further, the driving signal is ideally a rectangular-pulse current. However, as illustrated by a dashed line in FIG. 2A, an irradiance waveform of the ultraviolet rays which are actually irradiated by the LED light source 32 is a curved shape. The predetermined value i is defined such that peak irradiance for the irradiation time $t_1$ is approximately 0.75 W/cm$^2$.

In the irradiation condition table 10*a* as illustrated in FIG. 2B, a frequency F of the irradiation period P of a driving signal to be output to each LED light source 32 is defined for each of the ink types (W, C, M, Y, K, CL). Further, the frequency F of the irradiation period P is defined for each combination of a texture mode of a printed material and depending on whether CL is available or not. It is to be noted that the printed material does not indicate individual ink droplets, but indicates the entire print result on which a plurality of ink droplets are superimposed on one another on the recording medium. In the embodiment, a gloss mode, a semi-gloss mode, and a matte mode are prepared as the texture mode. The frequency F of the irradiation period P for W is defined to be 0 Hz regardless of whether CL is available or not in any of the texture modes. When the frequency F of the irradiation period P is 0 Hz, the current value I of the driving signal is always the predetermined value i and ultraviolet rays are continuously irradiated. The frequency F of the irradiation period P for CL is defined only when CL is available. The ultraviolet rays are not irradiated for CL by the LED light source 32 when CL is unavailable. The frequency F of the irradiation period P for CL is defined to be 200 Hz in the gloss mode, the frequency F of the irradiation period P for CL is defined to be 10 Hz in the semi-gloss mode, and the frequency F of the irradiation period P for CL is defined to be 0 Hz in the matte mode. The frequency F of the irradiation period P for each of C, M, Y, and K is defined to be 0 Hz regardless of the texture mode when CL is available. The frequency F of the irradiation period P for each of C, M, Y, and K is defined to be 200 Hz in the gloss mode, to be 10 Hz in the semi-gloss mode, and to be 0 Hz in the matte mode when CL is unavailable.

If the controller 10 acquires a combination of the texture mode of the printed material and whether CL is available or not, the controller 10 specifies the frequency F of the irradiation period P for each ink type, which corresponds to the combination, using the irradiation condition table 10*a* as a reference. Then, the controller 10 outputs a control signal for generating a driving signal of the frequency F of the irradiation period P, which has been specified for each ink type, to each driving signal generation circuit 31 corresponding to each ink type. Using this method, each driving signal generation circuit 31 corresponding to each ink type generates the driving signal and outputs the driving signal to the corresponding LED light source 32. It is to be noted that the combination of the texture mode of the printed material and whether CL is available or not does not change in the middle of printing a single print job. Therefore, the frequencies F of the irradiation period P do not change during a print period of the single print job. Further, although not illustrated in the drawings, each driving signal generation circuit 31 includes a DC power supply circuit, a variable frequency oscillation circuit, a switching circuit, and the like. The DC power supply circuit supplies a DC current of which current value I is the predetermined value i. The variable frequency oscillation circuit generates pulse waves each having the frequency F. The switching circuit switches the DC current based on the pulse waves. The controller 10 corresponds to an irradiation controller and a frequency setting unit. It is to be noted that the LED light sources 32 as solid-state light emitting elements are used so that periodic irradiation of ultraviolet rays can be easily controlled by a current pulse.

The transportation unit 40 includes a transportation motor, a transportation roller, a motor driver, and the like (they are not illustrated). The transportation unit 40 transports a recording medium in the transportation direction based on a control signal from the controller 10. With this, ink droplets can be directed so as to land on positions on the recording medium in the transportation direction and the width direction so as to form a two-dimensional printed image. Further, positions on the recording medium can be sequentially moved to positions just under the print heads 22 corresponding to the ink types so that ink droplets can be adhered in the order of W→C→M→Y→K→CL from the lower side in a superimposed manner. That is to say, an ink droplet of W containing a white color material is adhered to the recording medium first. Then, ink droplets of C, M, Y, and K are adhered to the recording medium in this order. Finally, an ink droplet of transparent CL is adhered to the recording medium. In the embodiment, the ink droplet of CL corresponds to a first-type liquid droplet, the ink droplet of W corresponds to a second-type liquid droplet and the ink droplets of C, M, Y, and K correspond to a third-type liquid droplet.

Further, an ink droplet, which has been adhered just before, is moved to an irradiation range A of the LED light source 32 corresponding to an ink type of the ink droplet so as to be cured by ultraviolet rays while an ink droplet of each ink type is adhered. Further, the ink droplet is cured while moving in the irradiation range A, and then, the recording medium is further transported so that an ink droplet of a subsequent ink type is adhered thereto in a superimposed manner. That is to say, an ink droplet of each ink type is individually irradiated with ultraviolet rays by the LED light source 32 corresponding to the ink type. It is needless to say that ink droplets which have been previously adhered are also irradiated with ultraviolet rays by the LED light sources 32 corresponding to the ink types of ink droplets which are subsequently applied. However, the ink droplets which have been previously applied have been already cured to some degree. Therefore, influence, which is given by the LED light sources 32 corresponding to the ink types of ink droplets which are adhered later, on surface glossiness of the ink droplets which have been previously adhered can be neglected.

It is to be noted that if the ink droplet of W is formed on a lowermost layer (at the side which is the closest to the recording medium), even when the recording medium is not white, a base having flat spectral reflectance characteristics can be formed as same as a case where the recording medium is white. Ink droplets containing color materials of C, M, Y and K of which spectroscopic absorption characteristics are different from each other are superimposed on the base so that various colors can be reproduced. Then, if the ink droplet of CL is further superimposed thereon, a texture of a surface of the printed material can be adjusted by the ink droplet of CL. In the embodiment, a transportation speed of the recording medium when printing is performed at a constant rate is $v_1$ to $v_2$ (for example, $v_1$=200, $v_2$=1000 mm/sec). A length of time until an ink droplet is moved into the irradiation range A of the corresponding LED light source 32 since the ink droplet has been adhered to the recording medium is $d/v_2$ to $d/v_1$ seconds. Further, a length of time during which the ink droplet is irradiated with ultraviolet rays in the irradiation range A is $w/v_2$ to $w/v_1$ seconds.

The UI portion 50 includes a display portion which displays an image and an operation portion which captures a user operation. The UI portion 50 displays a print condition setting image for receiving a selection instruction of a texture mode of a printed material and an instruction as to whether CL is available or not on the display portion based on a control signal from the controller 10. Further, the UI portion 50 receives the selection instruction of the texture mode and the instruction whether CL is available or not for each print job by the operation portion and outputs an operation signal indicating the combination thereof to the controller 10. Accordingly, the controller 10 acquires the combination of the texture mode of the printed material and whether CL is available or not for each print job so as to specify the frequency F of the irradiation period P corresponding to the combination.

Next, a print result of a printed material which is printed on the recording medium by the above-described image formation apparatus 1 is described.

2. Print Result

Figure 3A:
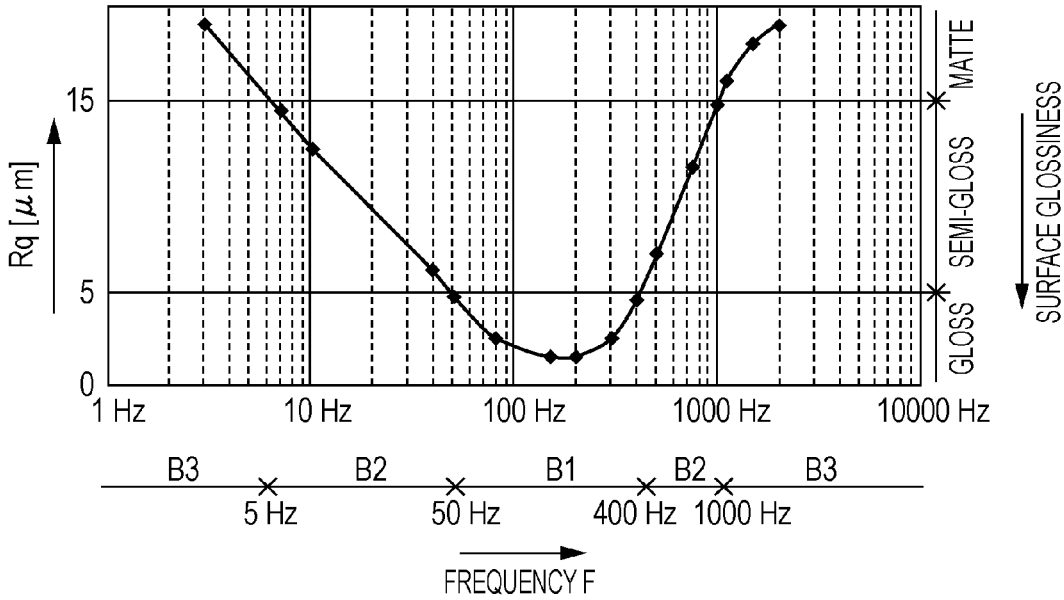
FIG. 3A is a graph illustrating surface roughness.

FIG. 3A is a graph illustrating surface roughness (surface glossiness) and FIGS. 3B to 3G are schematic views illustrating printed materials. In FIG. 3A, a longitudinal axis indicates surface roughness Rq and a transverse axis indicates the frequency F (log) of the irradiation period P. The surface roughness Rq is measured with the following procedures. At first, a weight c of ink droplet is adhered to a recording medium and the ink droplet is cured with ultraviolet rays having the frequency F so as to form a measurement sample. It is to be noted that in the embodiment, the measurement sample is formed with an ink droplet of CL which is superimposed at the uppermost surface and which largely contributes to surface glossiness. A height h(x) of a surface at each position x of the measurement sample is measured over a zone (x=0 to l) of a length l by an optical method such as the depth-of-focus method, for example. Note that the length l is desirably made to be sufficiently smaller than a size of the ink droplet in the direction parallel with the recording medium such that the height h(x) is not influenced by a curvature shape of the ink droplet itself. In addition, the height h(x) may be obtained by measuring displacement of a probe which makes contact with the surface of the measurement sample. Next, the height (x) is substituted into the following equation (Equation 1) so as to obtain surface roughness Rq.

$$Rq = \sqrt{\frac{1}{l}\int_o^l f(x)^2\,dx} \qquad \text{(Equation 1)}$$

$$f(x) = h(x) - \frac{1}{l}\int_o^l h(x)\,dx$$

As indicated by Equation 1, the surface roughness Rq corresponds to a root mean square of deviation f(x) with respect to an average value of the height h(x). As the surface roughness Rq decreases, the surface of the measurement sample is more like a mirrored surface. Therefore, as the surface roughness Rq decreases, surface glossiness is higher.

As illustrated in FIG. 3A, when the frequency F of the irradiation period P is 150 to 200 Hz, the surface roughness Rq is a minimum value (approximately 1.5 μm) and the surface glossiness of the measurement sample is a maximum value. When the frequency F of the irradiation period P is in a gloss band B1 of equal to or higher than 50 Hz and lower than 400 Hz, the surface roughness Rq is lower than a first threshold value (5 μm) and the surface glossiness of the measurement sample is higher than that corresponding to the first threshold value of the surface roughness Rq. Further, when the frequency F of the irradiation period P is in a semi-gloss band B2 of equal to or higher than 5 Hz and lower than 50 Hz, or equal to or higher than 400 Hz and lower than 1000 Hz, the surface roughness Rq is equal to or higher than the first threshold value and lower than the second threshold value (approximately 15 μm) and the surface glossiness of the measurement sample is higher than that corresponding to the second threshold value of the surface roughness Rq and equal to or lower than that corresponding to the first threshold value of the surface roughness Rq. On the other hand, when the frequency F of the irradiation period P is in a matte band B3 of lower than 5 Hz or equal to or higher than 1000 Hz, the surface roughness Rq is equal to or higher than the second threshold value and the surface glossiness of the measurement sample is equal to or lower than that corresponding to the second threshold value of the surface roughness Rq.

Figure 4:
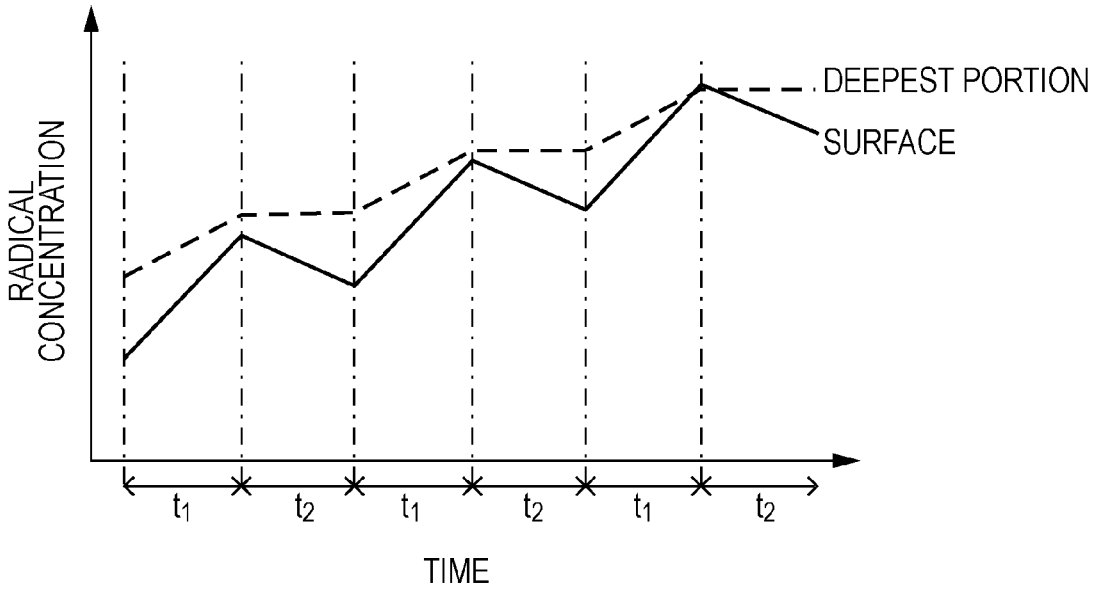
FIG. 4 is a graph illustrating radical concentration.

FIG. 4 is a graph illustrating radical concentration in an ink droplet. The radical concentrations on a surface of the ink droplet and a deepest portion thereof can be modeled under the following condition. At first, the radical concentration on the deepest portion is increased by 50% of increment of the radical concentration on the surface per unit time for the irradiation time $t_1$ (FIG. 2A) during which ultraviolet rays are irradiated. This is because the ultraviolet rays decay as proceeding in the depth direction of the ink droplet so that energy of ultraviolet rays required for generation of radicals is applied to the surface from only one side. Another reason is that a radical chain generated near the surface is more likely to terminate near the surface so that radical concentration is difficult to increase on the deepest portion of the ink droplet. On the other hand, the radical concentration on the surface is decreased per unit time by 40% of increment of the radical concentration for the irradiation time $t_1$ during which ultraviolet rays are irradiated for the irradiation time $t_2$ (FIG. 2A) during which ultraviolet rays are not irradiated. Further, oxygen is not diffused to the deepest portion of the ink droplet so that the radical concentration on the deepest portion is not influenced by oxygen inhibition for any of the irradiation time $t_1$ and the termination time $t_2$.

As illustrated in FIG. 4, the increment of the radical concentration on the surface is larger than that on the deepest portion for the irradiation times $t_1$. Therefore, the radical concentration on the surface becomes higher than that on the deepest portion. On the other hand, only the surface is influenced by the oxygen inhibition for the termination times $t_2$ and the radical concentration on the surface is decreased. Therefore, difference of the radical concentration between the surface and the deepest portion, which has been generated for the irradiation times $t_1$, is suppressed for the termination times $t_2$. Accordingly, if the irradiation time $t_1$ and the termination time $t_2$ are repeated, the radical concentration can be increased while suppressing the difference of the radical concentration between the surface and the deepest portion. That is to say, the ink droplet on the surface and the deepest portion can be progressively cured in a balanced manner so that contractions on the surface and the deepest portion with the curing of the ink droplet can be made to be equivalent. Accordingly, a problem that irregularities are formed on the surface due to deformation of the ink droplet and the surface glossiness is deteriorated can be prevented from occurring, thereby realizing high surface glossiness. As the difference of the radical concentration between the surface and the deepest portion decreases, higher surface glossiness can be realized.

Further, as illustrated in FIG. 3A, it was confirmed that the surface glossiness of the ink droplet depends on the frequency F of the irradiation period P for which each irradiation time $t_1$ is started. It is estimated that this fact is recognized because if the frequency F is changed, relative balance among a length of the irradiation period P (irradiation time $t_1$, termination time $t_2$), a reaction rate of radical polymerization reaction, and an oxygen diffusion rate in the ink droplet varies. As illustrated in FIG. 3A, when the frequency F of the irradiation period P is in the matte band B3, a model as illustrated in FIG. 4 is not established. If the frequency F of the irradiation period P is lower than 5 Hz in the matte band B3, it is estimated that the termination time $t_2$ becomes too long with respect to the oxygen diffusion rate and the oxygen inhibition also occurs on the deepest portion of the ink droplet. In this case, the entire ink droplet is likely to be uncured. On the other hand, if the frequency F of the irradiation period P is equal to or higher than 1000 Hz in the matte band B3, it is estimated that the termination time $t_2$ becomes too short with respect to the oxygen diffusion rate and one-sided curing on the surface cannot be suppressed by the oxygen inhibition. It is to be noted that even when a thickness of the ink droplet on the measurement sample is changed to 5 to 10 μm, and an ink type used for the measurement sample is changed, the surface roughness Rq which is substantially the same as that in FIG. 3A was obtained.

Figure 3B:
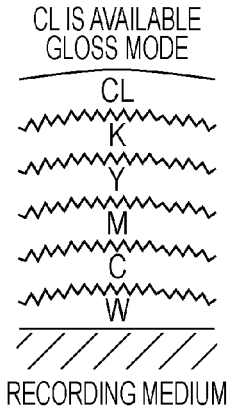
FIGS. 3B to 3G are views schematically illustrating printed materials.
Figure 3D:
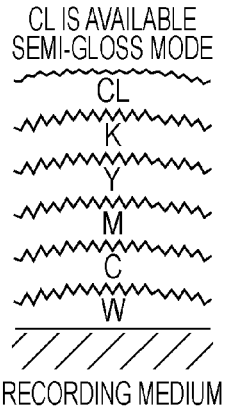
Figure 3F:
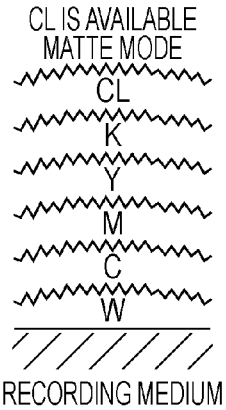
Figure 3C:
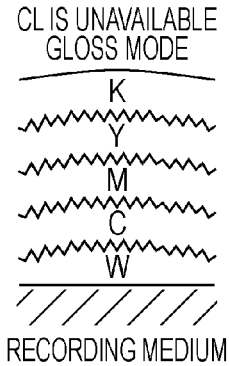
Figure 3E:
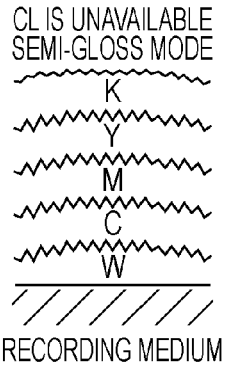
Figure 3G:
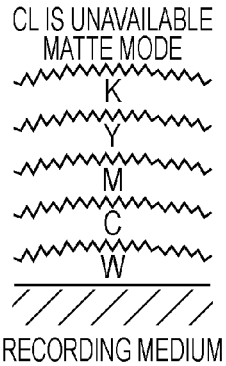

FIG. 3B to 3G are plan views schematically illustrating a printed material (orthogonally-cut cross section of a recording medium (hatching)) for each combination of the texture mode and depending on whether CL is available. FIGS. 3B, 3D, and 3F illustrate a printed material when CL is available and FIGS. 3C, 3E, and 3G illustrate a printed material when CL is unavailable. Further, FIGS. 3B and 3C illustrate a printed material when the texture mode is the gloss mode, FIGS. 3D and 3E illustrate a printed material when the texture mode is the semi-gloss mode, and FIGS. 3F and 3G illustrate a printed material when the texture mode is the matte mode.

In the irradiation condition table 10*a* as illustrated in FIG. 2B, the frequency F of the irradiation period P for W is 0 Hz in the matte band B3 regardless of the texture mode and whether CL is available or not and the surface glossiness of the ink droplet of W is decreased. Therefore, scattered reflection on the surface is accelerated so as to enhance whiteness. Further, as illustrated in FIGS. 3B to 3G, considering that ink droplets of other ink types are superimposed on and bonded to the ink droplet of W, the surface glossiness of the ink droplet of W is decreased. As the surface glossiness of the ink droplet decreases, that is to say, as the surface roughness Rq is higher, a bonding area between the ink droplets which are superimposed on one another in the thickness direction is increased so that high bonding strength can be obtained. Further, the ink droplet of W is formed at the side of the recording medium which is the farthest from the printed surface and contribution thereof to the texture of the surface is lowered. Therefore, there arises no problem even when the surface glossiness of the ink droplet of W is reduced regardless of the texture mode.

On the other hand, when CL is available as illustrated in FIGS. 3B, 3D, and 3F, since the ink droplet of CL is formed on an uppermost surface, contribution thereof to the texture of the printed material is the largest. Accordingly, in the irradiation condition table 10*a* as illustrated in FIG. 2B, when the texture mode is the gloss mode, the frequency F of the irradiation period P for CL is 200 Hz in the gloss band B1. Further, when the texture mode is the semi-gloss mode, the frequency F of the irradiation period P for CL is 10 Hz in the semi-gloss band B2. When the texture mode is the matte mode, the frequency F of the irradiation period P for CL is 0 Hz in the matte band B3. With this, when CL is available, the printed material having the surface glossiness desired by a user can be obtained. It is to be noted that when CL is available, the frequency F of the irradiation period P for each of W, C, M, Y, and K is 0 Hz in the matte band B3 in order to improve the bonding strength between each ink droplet and the ink droplet at an upper layer. When CL is available, since influence given by the ink droplets of W, C, M, Y, and K on the texture of the surface is small, there arises no problem even when the bonding strength is valued.

In contrast, when CL is unavailable, as illustrated in FIGS. 3C, 3E, and 3G, influence given by ink droplets of C, M, Y, and K on the texture of the surface is large. Accordingly, in the irradiation condition table 10*a* as illustrated in FIG. 2B, when CL is unavailable, the frequency F of the irradiation period P for each of C, M, Y, and K is defined to be a value in accordance with the texture mode. That is to say, when the texture mode is the gloss mode, the frequency F of the irradiation period P for each of C, M, Y, and K is 200 Hz in the gloss band B1. When the texture mode is the semi-gloss mode, the frequency F of the irradiation period P for each of C, M, Y, and K is 10 Hz in the semi-gloss band B2. Further, when the texture mode is the matte mode, the frequency F of the irradiation period P for each of C, M, Y, and K is 0 Hz in the matte band B3.

As described above, if the frequency F of the irradiation period P is set to be a value in the gloss band B1 or the semi-gloss band B2, higher surface glossiness of the ink droplet can be obtained in comparison with a case where ultraviolet rays are continuously irradiated. Further, if the frequency F of the irradiation period P is switched in accordance with the selected and instructed texture mode, a printed material having desired surface glossiness can be obtained. In addition, if the frequency F of the irradiation period P is set depending on an ink type, surface glossiness (surface roughness) of an ink droplet, which is suitable for a function of ink and an adherence order of the ink droplet, can be realized.

3. Variations

The frequency F of the irradiation period P which is in the gloss band B1 or the semi-gloss band B2 is set may vary from the frequencies F defined in the irradiation condition table 10*a* in the above embodiment. Further, while in the above embodiment, the frequency F of the irradiation period P is set uniformly for C, M, Y, and K, the frequencies F of the irradiation period P may differ among C, M, Y, and K may be set. That is to say, the frequency F of the irradiation period P may be set such that the surface glossiness of an ink droplet is increased toward an ink type of which ink droplet is adhered later among C, M, Y, and K. In addition, as illustrated in FIGS. 3B to 3G, a possibility that ink droplets are superimposed in the thickness direction are lowered as a recording density of an ink droplet which is adhered later is also decreased. Accordingly, the frequency F of the irradiation period P which realizes high surface glossiness may be set for an ink type of which ink droplet is discharged previously as image data to be printed indicates lighter ink color.

Further, the invention may be applied to a serial printer in which ink droplets are discharged while a carriage (print head) moves in a main scanning direction perpendicular to a transportation direction of a recording medium. In this case, an irradiator may be provided on the carriage or may be provided separately from the carriage. It is needless to say that not only in an image formation apparatus which uses a plurality of types of inks but also in an image formation apparatus which uses a single color ink, a monochrome print image having high surface glossiness can be also obtained by setting the frequency F of the irradiation period P. In addition, in the above embodiment, the frequency F of the irradiation period P of ultraviolet rays is set. However, the frequency F of the irradiation period P of other electromagnetic waves such as visible light and microwaves may be set. With this, a printed material having high surface glossiness can be also obtained with ink droplets which cure with other electromagnetic waves. It is needless to say that a generation source of the electromagnetic wave is not limited to an LED and may be a rare gas light source or the like.

What is claimed is:

1. An image formation apparatus comprising:

a liquid droplet adhesion unit which makes a first-type liquid droplet and a second-type liquid droplet adhere to a recording medium, the first-type liquid droplets being adhered to the recording medium after the second-type liquid droplet;

a first irradiation controller which controls an irradiator to cause the irradiator to irradiate electromagnetic waves onto the first-type liquid droplet at a first frequency periodically; and a second irradiation controller which controls an irradiator to cause the irradiator to irradiate electromagnetic waves onto the second-type liquid droplet, wherein when the second-type liquid droplet is adhered to the recording medium, the second irradiation controller makes the irradiator irradiate the electromagnetic waves at a first second frequency periodically, and wherein when the second-type liquid droplet is not adhered to the recording medium, the second irradiation controller makes the irradiator irradiate the electromagnetic waves at the first frequency periodically, wherein a surface glossiness of the first-type liquid droplet onto which the electromagnetic waves are irradiated by the first irradiation controller is equal to or higher than a predetermined threshold value, and wherein a surface glossiness of the second-type liquid droplet onto which the electromagnetic waves are irradiated by the second irradiation controller is lower than the threshold value.

2. The image formation apparatus according to claim 1, wherein the second-type liquid droplet contains a white color material.

3. The image formation apparatus according to claim 1, wherein the first frequency is equal to or higher than 5 Hz and lower than 1000 Hz, and the second frequency is lower than 5 Hz, or equal to or higher than 1000 Hz.

4. The image formation apparatus according to claim 3, wherein thicknesses of the first-type liquid droplet and the second-type liquid droplet are equal to or larger than 5 μm and equal to or lower than 10 μm.

5. A liquid droplet adhesion unit which makes a first-type liquid droplet and a second-type liquid droplet which is different from the first-type liquid droplet adhere to a recording medium;

an irradiator which irradiates electromagnetic waves individually onto the first-type liquid droplet and the second-type liquid droplet which have been adhered to the recording medium;

an irradiation controller which makes the irradiator irradiate the electromagnetic waves periodically; and a frequency setting unit which sets a frequency of an irradiation period which is a period in which the electromagnetic waves are irradiated by the irradiator to a first frequency such that surface glossiness of the first-type liquid droplet is equal to or higher than a predetermined threshold value, and sets a frequency of the irradiation period to a second frequency which is different from the first frequency such that surface glossiness of the second-type liquid droplet is lower than the threshold value, wherein the liquid droplet adhesion unit makes the second-type liquid droplet adhere to the recording medium before the first-type liquid droplet is adhered wherein the liquid droplet adhesion unit makes a third-type liquid droplet adhere to the recording medium after the second-type liquid droplet has been adhered, wherein the first-type liquid droplet is transparent, and wherein the image formation apparatus further comprises a third irradiation controller which controls the irradiator to cause the irradiator to irradiate electromagnetic waves onto the third-type liquid droplet, wherein when the first-type liquid droplet is adhered to the recording medium, the third irradiation controller makes the irradiator irradiate the electromagnetic waves at the second frequency periodically, and when the first-type liquid droplet is not adhered to the recording medium, the third irradiation controller makes the irradiator irradiate the electromagnetic waves at the first frequency periodically.

6. An image formation apparatus comprising:

a liquid droplet adhesion unit which makes a white type liquid droplet, a transparent liquid droplet, and a non-white colored liquid droplet adhere to a recording medium, the non-white colored liquid droplets being adhered to the recording medium before the transparent liquid droplet;

a first irradiation controller which controls an irradiator to cause the irradiator to irradiate electromagnetic waves onto the transparent liquid droplet at a first frequency periodically; and a second irradiation controller which controls an irradiator to cause the irradiator to irradiate electromagnetic waves onto the white type liquid droplet at a second frequency periodically, a third irradiation controller which controls the irradiator to cause the irradiator to irradiate electromagnetic waves onto the non-white colored liquid droplet, wherein when the transparent liquid droplet is adhered to the recording medium, the third irradiation controller makes the irradiator irradiate the electromagnetic waves at the second frequency periodically, and wherein when the transparent liquid droplet is not adhered to the recording medium, the third irradiation controller makes the irradiator irradiate the electromagnetic waves at the first frequency periodically, wherein a surface glossiness of the transparent liquid droplet onto which the electromagnetic waves are irradiated by the first irradiation controller is equal to or higher than a predetermined threshold value, and wherein a surface glossiness of the white liquid droplet onto which the electromagnetic waves are irradiated by the second irradiation controller is lower than the threshold value.

7. The image formation apparatus according to claim 6, wherein the liquid droplet adhesion unit also makes the white liquid droplet adhere to the recording medium before the non-white colored liquid droplet is adhered to the recording medium.

8. The image formation apparatus according to claim 6, wherein the first frequency is equal to or higher than 5 Hz and lower than 1000 Hz, and the second frequency is lower than 5 Hz, or equal to or higher than 1000 Hz.

9. The image formation apparatus according to claim 8, wherein thicknesses of the transparent liquid droplet and the white liquid droplet are equal to or larger than 5 μm and equal to or lower than 10 μm.

* * * * *